US005344541A

United States Patent [19]

Uffinger

[11] Patent Number: 5,344,541

[45] Date of Patent: Sep. 6, 1994

[54] SILVER RECOVERY DEVICE

[75] Inventor: Gerhard Uffinger, Weinstadt-Grobheppach, Fed. Rep. of Germany

[73] Assignee: Eastman Kodak Company, Rochester, N.Y.

[21] Appl. No.: 39,123

[22] PCT Filed: Jul. 30, 1992

[86] PCT No.: PCT/EP92/01732

§ 371 Date: Apr. 2, 1993

§ 102(e) Date: Apr. 2, 1993

[87] PCT Pub. No.: WO93/03203

PCT Pub. Date: Feb. 18, 1993

[30] Foreign Application Priority Data

Aug. 3, 1991 [DE] Fed. Rep. of Germany ..... 4125771

[51] Int. Cl.[5] ..... C25C 7/00

[52] U.S. Cl. ..... 204/272; 204/275; 204/278; 204/294

[58] Field of Search ..... 204/272, 275–278, 204/294

[56] References Cited

U.S. PATENT DOCUMENTS

| | | | |
|---|---|---|---|
| 3,985,634 | 10/1976 | Larson et al. | 204/212 |
| 4,026,784 | 5/1977 | Rivers | 204/272 X |
| 4,028,212 | 6/1977 | Bowen et al. | 204/272 |
| 4,069,127 | 1/1978 | Salemi et al. | 204/229 |
| 4,280,884 | 7/1981 | Babb et al. | 204/272 X |
| 4,302,318 | 11/1981 | Mock | 204/272 X |
| 4,802,961 | 2/1989 | Wood et al. | 204/272 X |
| 4,804,452 | 2/1989 | Rhodes | 204/272 X |

FOREIGN PATENT DOCUMENTS

| | | |
|---|---|---|
| 58516-A | 8/1982 | European Pat. Off. . |
| 4007906-C | 12/1990 | Fed. Rep. of Germany . |
| 578626 | 8/1976 | Switzerland . |

*Primary Examiner*—Donald R. Valentine
*Attorney, Agent, or Firm*—Clyde E. Bailey

[57] ABSTRACT

A cylindrical electrolysis tank (10) whose inner wall surface (11c) is held in contact with a single-use cathode (30) defining a hollow cylinder is provided with a removable tank lid (14) which forms an integral unit with a hollow cylinder (16) which carries the anode (34) on its peripheral surface (16a) and is provided with an uninterrupted closed bottom plate (17). The cylinder space (24) which is freely accessible from above serves to accommodate a replacement cathode (30) which is rolled up. At the circumferential abutment edge (18) between the peripheral surface (16a) of hollow cylinder (16) and the inner surface (19a) of lid plate (19) a ventilation groove (20) is provided which has a bore (20a) including an air-exhaust valve (21) and extending to the exterior.

10 Claims, 1 Drawing Sheet

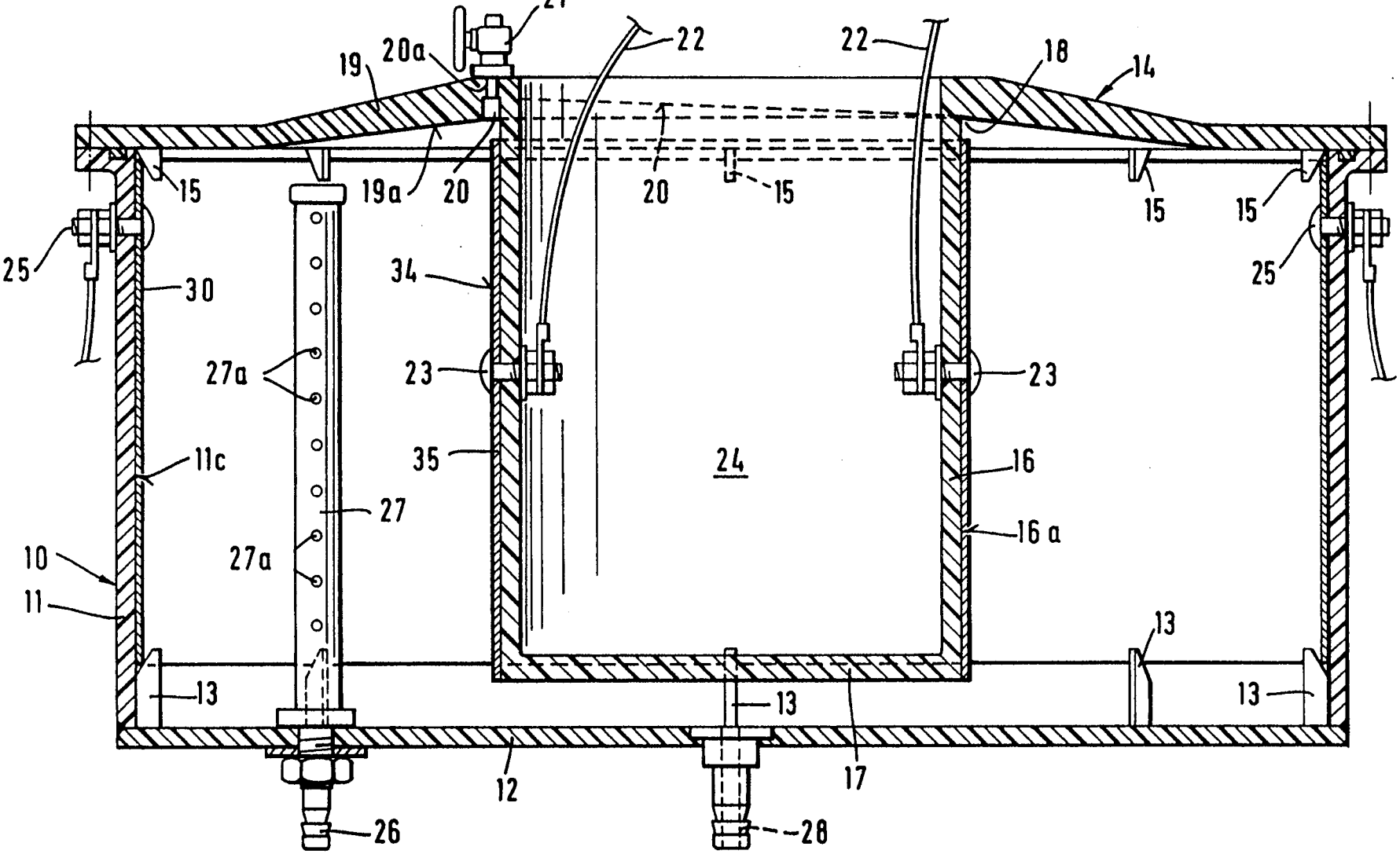
10
11
11c
12
13
14
15
16
16a
17
18
19
19a
20
20a
21
22
23
24
25
26
27
27a
28
30
34
35

SILVER RECOVERY DEVICE

The invention relates to a device for electrolytically recovering silver from a photographic processing fluid, said device comprising a cylindrical electrolysis tank with a fluid supply pipe and a fluid discharge pipe arranged in its bottom as well as a removable tank lid including a ventilation means, a hollow-cylindrical anode arranged concentrically within the cylindrical tank, a single-use cathode in the form of a hollow cylinder which rests against the inner surface of the tank wall as well as electric connections for the cathode and the anode.

DE-PS 40 07 906 discloses a device of this type in which the anode extending into the electrolysis tank is screwed to the tank lid.

The anode consists of a plastic cylinder and a holding bracket. The outer surface of the cylinder as well as the inner surface of the holding bracket are covered by an adhesively attached graphite foil. The bracket is screwed to the cylinder such that the graphite surfaces rest on each other and form an electric contact. By means of two further screws the bracket together with the cylinder is attached to the inner surface of the lid. The attachment screws which extend through the lid also serve as connections to the outside power supply.

This arrangement is disadvantageous in that the tank lid and the anode arrangement consist of a plurality of parts which are screwed together and whose assembly is very time-consuming.

It is the object of the invention to provide a tank lid and an anode arrangement which consists of a small number of parts, which is easy to manufacture and whose assembly requires a minimum of operations.

According to the invention this object is attained in that the tank lid forms an integral unit with a hollow cylinder which extends into the electrolysis tank from above and carries the anode on its peripheral surface.

According to an advantageous modification the hollow cylinder has a closed bottom plate and defines a cylinder space which is freely accessible from above.

The advantage attainable by the invention consists in that the tank lid and the anode holder form one single component which can be made in one step. Moreover the current is homogeneously distributed between cathode and anode within the electrolytic cell.

The invention will be described with reference to an embodiment schematically illustrated in the drawing.

The single FIGURE shows a lateral sectional view of a silver recovery device of substantially the same design as that proposed in DE-PS 40 07 906. Therefore the description of the subject matter of the invention with reference to the FIGURE only deals with those parts as contributing to a better understanding of the invention.

The cylindrical plastic electrolysis tank generally denoted 10 is provided with a fixedly arranged bottom plate 12 and a removable tank lid 14. The marginal area of bottom plate 12 features noses 13 and the marginal area of the lower side of the lid noses 15, which extend into tank 10 and rest against the inner surface 11*c* of tank wall 11. The noses serve to hold a cylindrical single-use cathode 30 of the type described in the above-mentioned DE-PS 40 07 906 in contact with the inner surface 11*c* of tank wall 11.

Moreover two clamping bolts 25 are provided by means of which electric contact is made with the single-use cathode provided with the negative cable, said cathode being thus additionally held.

A fluid discharge pipe 28 is arranged in the center of bottom plate 12 and a fluid supply pipe 26 at any suitable point of the range of bottom plate 12 between an anode 34 and the cathode 30. Inserted into said discharge pipe is an upright tube 27 which is provided with nozzles 27*a* and sealed by a cover.

The tank lid 14 according to the invention which includes an area upwardly inclined at a slight angle or having a slight upward curvature forms an integral unit with a hollow cylinder 16 which extends downwards into the electrolysis tank 10. Anode 34 which consists of a thin foil 35 coated with carbon is bonded to its peripheral surface 16*a*. The hollow cylinder 16 is closed by a bottom plate 17 and defines a cylinder space 24 freely accessible from above. On half the level of the cylinder space, two oppositely arranged threaded buttonhead bolts 23 are provided which extend through the cylinder wall and the carbon foil 35 of anode 34. The bolt ends projecting into the cylinder space 24 are connected with the positive cable 22 for the electric power supply. The cable ends are each clamped between two nuts screwed onto the threaded bolts 23. O-rings (not illustrated) placed on the threaded bolts between the nuts and the wall of the hollow cylinder 16 serve as sealing members.

At the circumferential abutment edge 18 between the peripheral surface 16*a* of hollow cylinder 16 and the inner surface 19*a* of the circular lid plate 19, a circumferential ventilation groove 20 is provided in the inner surface 19*a*, said groove having a pretermined depth on one side and rising on either side such that it terminates in the inner surface 19*a* of circular lid plate 19 on the diametrically opposite side. As can be seen from the FIGURE, a bore 20*a*, into which an air-exhaust valve 21 is inserted, extends from the deepest level of ventilation groove 20 to the exterior.

As was described above, the tank lid and the anode holder form an integral unit which can be manufactured rapidly and without problem with a minimum of material in one single operation, for example by means of an extrusion molding process. Moreover, in the free space 24 of hollow cylinder 16, which is accessible from outside, a cylindrical single-use replacement cathode 30 may be deposited. In addition, when lid 14 is lifted during opening of the electrolysis tank the fluid level is lowered in proportion to the volume of the hollow cylinder 16 closed by bottom plate 17 so that there is no danger of fluid overflowing and being spilled respectively.

I claim:

1. Device for electrolytically recovering silver from a photographic processing fluid, said device comprising a cylindrical electrolysis tank with a removable lid including a ventilation means, a bottom and cylindrical walls having an inner surface surrounding the bottom, said bottom being provided with a fluid supply pipe and a fluid discharge pipe arranged therein, a hollow-cylindrical anode arranged concentrically within the tank, a single-use cathode in the form of a first hollow cylinder which rests against the inner surface of the walls, and electrical connections for the cathode and anode, characterized in that the tank lid forms an integral unit with a second hollow cylinder which extends downwards into the electrolysis tank, said second hollow cylinder having a peripheral surface, and wherein said anode being mounted on said peripheral surface.

2. Device according to claim 1, characterized in that said second hollow cylinder (16) comprises a closed bottom plate (17) and defines a cylinder space (24) which is freely accessible from above.

3. Device according to claim 1, characterized in that a bolt is mounted in opposite walls of said second hollow cylinder, said bolts each having an end portion that extends through said respective wall, into and through the carbon foil of said anode and terminates in the second hollow cylinder, each said end portion terminating in said second hollow cylinder provide a connection for positive cable from an electric power supply.

4. Device according to claim 1, characterized in that said tank lid comprises a circular lid plate, said circular lid plate having an inner surface.

5. Device according to claim 4 characterized in that a circumferential abutment edge is defined between said peripheral surface of said second hollow cylinder and the inner surface of said circular lid plate.

6. Device according to claim 5, characterized in that a circumferential ventilation groove is provided in said inner surface.

7. Device according to claim 6, characterized in that said ventilation groove (20) has a predetermined depth on one side and rises on either side such that it terminates in the inner surface (19*a*) of the circular lid plate (19) on the diametrically opposite side.

8. Device according to claim 7, characterized in that a bore (20*a*), into which an air-exhaust valve (21) is inserted, extends from the deepest level of the ventilation groove (20) to the exterior.

9. Device according to claim 6, characterized in that a bore (20*a*), into which an air-exhaust valve (21) is inserted, extends from the deepest level of the ventilation groove (20) to the exterior.

10. Device according to claim 1, characterized in that said anode consist of carbon foil.

* * * * *